United States Patent [19]

Howie, Jr.

[11] 4,446,811

[45] May 8, 1984

[54] KNOB AND SKIRT ASSEMBLY

[75] Inventor: Robert K. Howie, Jr., Decatur, Ill.

[73] Assignee: The Grigoleit Company, Decatur, Ill.

[21] Appl. No.: 310,435

[22] Filed: Oct. 13, 1981

[51] Int. Cl.[3] ..... G05G 1/10

[52] U.S. Cl. ..... 116/309; 116/311

[58] Field of Search ..... 116/309, 316, 317, 311, 116/245, 312, 314, 306, 320; 403/365

[56] References Cited

U.S. PATENT DOCUMENTS

| | | | |
|---|---|---|---|
| 2,607,533 | 8/1952 | Main | 116/DIG. 46 |
| 2,794,412 | 6/1957 | Rauth | 116/DIG. 46 |
| 2,995,105 | 8/1961 | Maltby | 116/314 |
| 3,109,412 | 11/1963 | Fuhrman et al. | 116/312 |
| 3,154,051 | 10/1964 | Durst et al. | 116/312 |
| 3,916,721 | 11/1975 | Egger | 74/553 |
| 4,012,806 | 3/1977 | Howie, Jr. | 16/121 |
| 4,213,416 | 6/1980 | Klinger | 116/309 |

*Primary Examiner*—Charles Frankfort
*Assistant Examiner*—David R. Schuster
*Attorney, Agent, or Firm*—Kinzer, Plyer, Dorn & McEachran

[57] ABSTRACT

A knob and skirt assembly for mounting on the end of a control shaft which assembly has a dial which can be calibrated relative to the control shaft. The assembly includes a knob having a handle and a hub. The disc shaped skirt has a central opening adapted to receive the hub and to engage a stop to position the skirt relative to the hub. In one embodiment, tabs are formed on the hub and bent against the skirt to secure the skirt against the stop and to frictionally resist rotation of the hub and skirt relative to each other until a predetermined rotational force is applied to overcome this frictional resistance. In another embodiment, a spring washer is utilized for this purpose. A first set of indicia is applied to the skirt on the handle side thereof along the circumferential periphery of the skirt. A second set of indicia is applied to the skirt on the hub side thereof along the circumferential periphery thereof. In one embodiment, a pointer is formed on the hub and bent against the skirt to align with the second set of indicia. In another embodiment, a pointer is formed on the handle and extends through an arcuate opening formed in the skirt adjacent the second set of indicia. An inwardly projecting tab is formed on the skirt and engages the hub to limit rotational movement of the skirt relative to the hub when the frictional resistance between the skirt and hub is overcome.

6 Claims, 7 Drawing Figures

KNOB AND SKIRT ASSEMBLY

SUMMARY OF THE INVENTION

This invention is concerned with a knob and skirt assembly for mounting on the end of a control shaft, particularly a shaft used to control temperature.

An object of this invention is a knob and skirt assembly having a dial which can be calibrated relative to the control shaft.

Another object is a knob and skirt assembly for control shaft having a dial which can be incrementally calibrated relative to the control shaft.

Another object is a knob and skirt assembly having a dial which can be calibrated without the use of tools.

Another object is a knob and skirt assembly in which the rotational movement of the knob and skirt relative to each other is limited.

Another object is a knob and skirt assembly in which the calibration pointer is formed integrally with the hub.

Another object is a knob and skirt assembly in which the calibration pointer is formed integrally with the handle and extends through an arcuate opening in the skirt.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENTS

Figure 1:
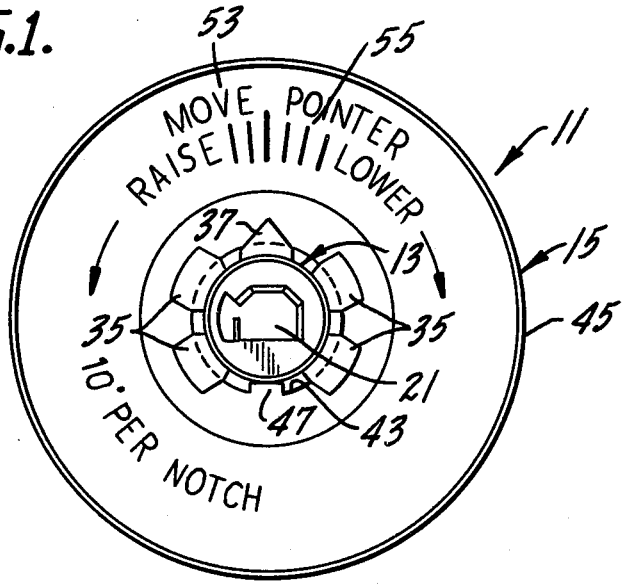
FIG. 1 is an enlarged bottom plan view of one embodiment of the knob and shirt assembly of this invention.
Figure 2:
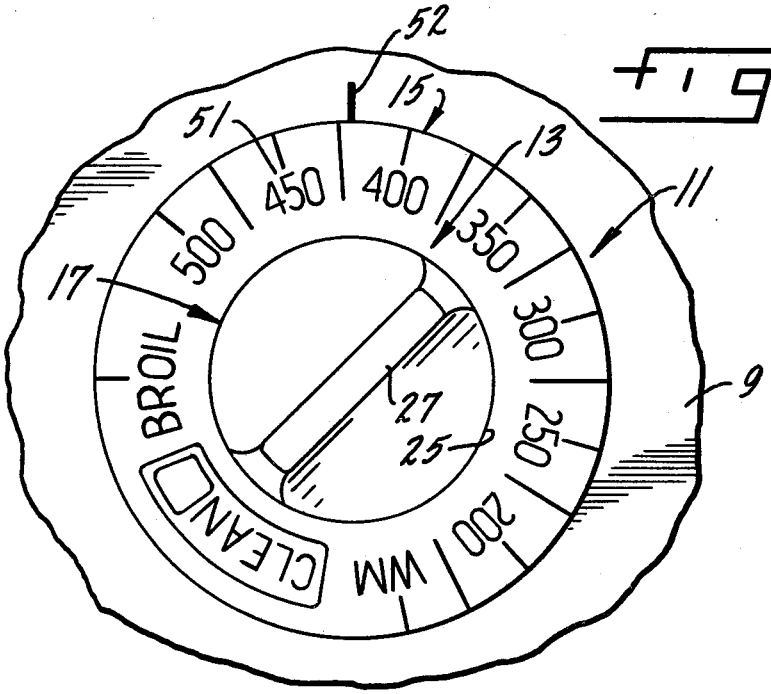
FIG. 2 is a top plan view of the knob and skirt of FIG. 1 mounted on an appliance.
Figure 3:
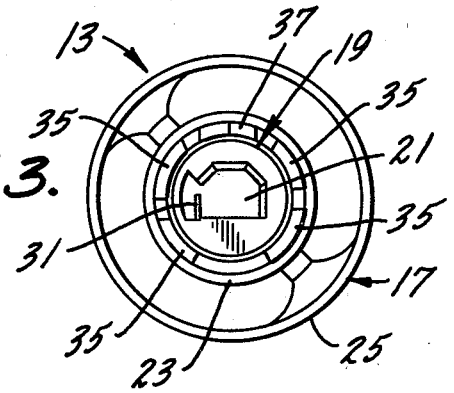
FIG. 3 is a view of the socket end of the knob of FIG. 1 prior to bending of the tabs and pointer and drawn approximately to scale.
Figure 4:
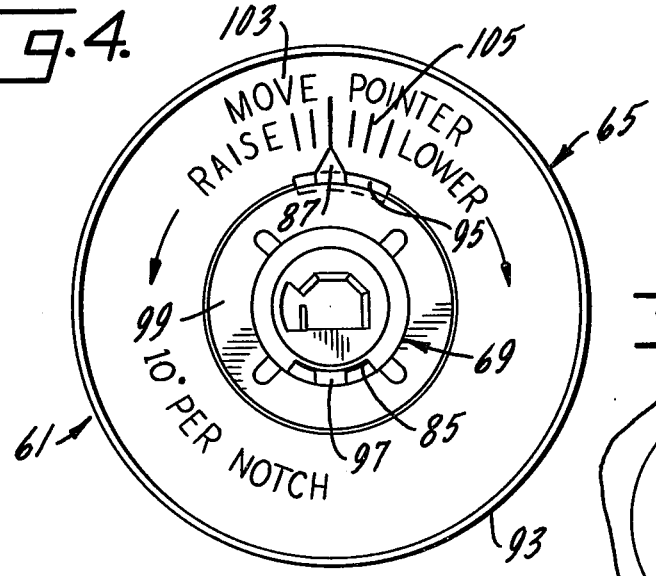
FIG. 4 is an enlarged bottom plan view of a second embodiment of the knob and skirt assembly of this invention.
Figure 5:
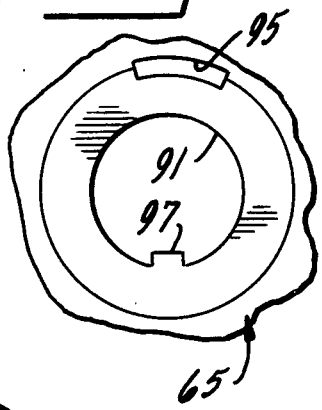
FIG. 5 is a partial bottom plan view of the knob and skirt assembly of FIG. 4 with the spring washer and knob removed for clarity of illustration.
Figure 6:
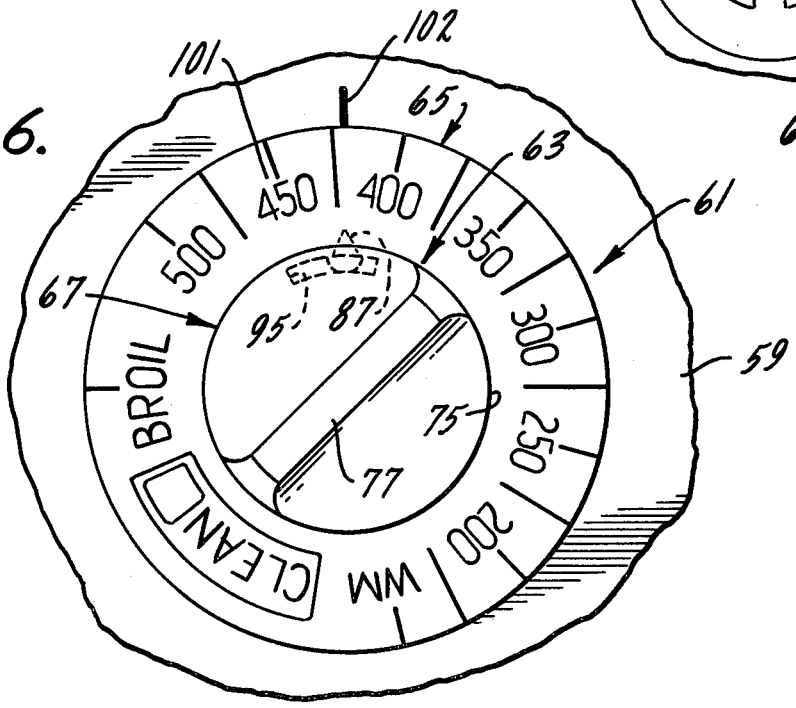
FIG. 6 is a top plan view of the knob and skirt of FIG. 4 mounted on an appliance.
Figure 7:
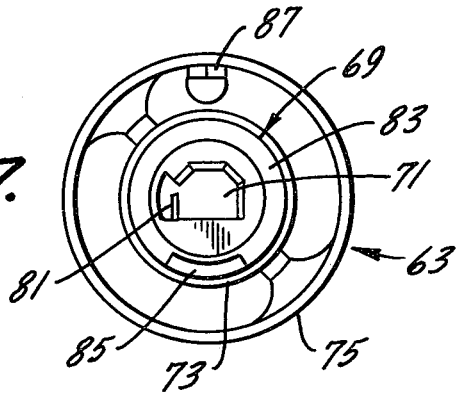
FIG. 7 is a view of the socket end of the knob of FIG. 4 prior to assembly and drawn approximately to scale.

One form of a knob and skirt assembly 11 embodying the novel features of this invention is shown in FIGS. 1 through 3 of the drawings. The knob and skirt assembly is intended to be mounted on the end of a shaft (not shown) of a temperature control mechanism such as a valve or rheostat. The particular knob and skirt assembly shown in the drawings is adapted for use on a shaft controlling a gas valve or an electrical rheostat on a stove or oven or similar appliance 9. However, the knob and skirt assembly of this invention should not be limited to only these enunciated uses but may be used on any control device having a rotatable shaft which must be calibrated relative to a dial.

The knob and skirt assembly 11 includes a knob 13 and an annular skirt 15. The knob has a handle portion 17 and a hub portion 19. The hub portion has a control shaft receiving socket 21 at one end and a stop in the form of a shoulder 23 located inwardly of the socket end 21 of the hub. The handle portion includes a cylindrical base 25 and a tapered blade-like portion 27 for gripping, extending from the cylindrical base.

The shaft receiving socket 21 is of irregular cross section designed to mate with a shaft (not shown) having a complementary configuration. The complementary shapes of the shaft receiving socket and the shaft provide for alignment of the hub of the knob with the shaft. The socket may have one or more fingers such as finger 31 to frictionally engage the shaft to hold the knob firmly on the shaft. However, it should be understood that this invention is not limited to sockets having flexible fingers to hold the knob on to the shaft but can be adapted to a knob having any type of a fastening means between the socket and the shaft. The knob may be molded of any suitable plastic.

Longitudinal ribs 35, in this example, four in number, are molded integrally on the periphery of the hub portion 19. The ribs extend from the shoulder 23 terminating short of the socket end 21 of the hub. The ribs are located in pairs on opposite diametrical sides of the hub and each pair of ribs and the ribs of each pair are spaced from each other. A fifth rib 37 is located between the pairs of ribs 35 and is triangular in shape with its apex pointing towards the socket end of the hub and its base located at the shoulder 23. As will be hereinafter explained, the ribs 35 and 37 are heat staked to form tabs and a pointer when the knob and skirt are assembled.

The skirt 15 is formed of a suitable metal such as an aluminum stamping. It is formed with a central opening 43, which closely fits over the hub 19 of the knob 13, and has a downwardly turned outer rim 45. The diameter of the central opening 43 is sufficiently large that the skirt is free to rotate relative to the hub 19 but is sufficiently small so that it cannot override the shoulder 23. To hold the skirt on the hub, the ribs 35 and 37 are heat staked and bent against the skirt to frictionally resist rotation of the hub and skirt relative to each other until a predetermined rotational force is applied to overcome this frictional resistance. The rib 37 also functions as a calibration pointer. A tab 47 is formed in the central opening 43 of the skirt. This tab extends between the bent over ribs 35 to limit rotational movement of the skirt relative to the knob. The tab is positioned to be located diametrically opposite to the pointer rib 37.

Indicia 51 indicating temperatures, in either the Fahrenheit or Celsius scales, are applied to the handle portion surface of the skirt 15 near the outer rim 45 thereof so that the indicia will be positioned outwardly of the cylindrical base 25 of the handle portion 17 of the hub when the skirt is installed on the hub. The indicia 51 is referenced to a mark 52 located on the appliance 9.

Indicia 53 is applied to the hub portion side of the skirt 15 along the circumferential periphery thereof. The indicia 53 includes radially extending linear marks 55, each of which is spaced apart an angular distance equivalent to a predetermined number of degrees of temperature as indicated by indicia 51, and instructions including letter and arrows indicating the direction in which to move the skirt relative to the knob 13 to raise or lower the temperature shown on the dial or indicia 51. The marks 55 of the indicia 53 are positioned so that the pointer rib 37 will be in alignment with these marks to aid in the calibration of the dial.

The heat staked ribs 35 will normally frictionally engage the skirt to prevent relative rotation between the skirt and the knob. However, when the skirt and knob assembly is removed from the shaft, relative rotation between the skirt and knob may easily be accomplished by overcoming the frictional engagement of these two members within the limits of rotation provided by engagement of the tab 47 with the ribs 35. Thus, upon removal of the knob from the shaft, the dial may easily be calibrated.

A second embodiment of the invention is shown in knob and skirt assembly 61 in FIGS. 4 through 7 of the drawings. This embodiment of the knob and skirt assembly is intended to be mounted on the end of a shaft (not shown) of a temperature control mechanism such as a valve or rheostat. The particular knob and skirt assembly shown in the drawings is adapted for use on a shaft controlling a gas valve or an electric rheostat on a stove or oven or similar appliance 59. However, the knob and skirt assembly of this invention should not be limited to only these enunciated uses but may also be used on any control device having a rotatable shaft which must be calibrated relative to a dial.

The knob and skirt assembly 61 includes a knob 63 and an annular skirt 65. The knob has a handle portion 67 and a hub portion 69. The hub portion has a control shaft receiving socket 71 at one end and a stop in the form of a shoulder 73 located inwardly of the socket end 71 of the hub. The handle portion includes a cylindrical base 75 and a tapered blade-like portion 77 for gripping, extending from the cylindrical base.

The shaft receiving socket 71 is of irregular cross section designed to mate with the shaft (not shown) having a complementary configuration. The complementary shapes of the shaft receiving socket and the shaft provide for alignment of the hub of the knob with the shaft. The socket may have one or more fingers such as finger 81 to frictionally engage the shaft to hold the knob firmly on the shaft. However, it should be understood that this invention is not limited to sockets having flexible fingers to hold the knob onto the shaft but can be adapted to a knob having any type of a fastening means between the socket and the shaft. The knob may be injection molded of any suitable high temperature thermoplastic or thermosetting plastic.

An annular wall 83 which extends from the shoulder stop 73 and terminates short of the shaft socket 71 is formed integrally on the hub portion 69. An arcuately extending notch 85 is formed in the annular wall 83 on one side of the hub portion. An axially extending pointer 87 is molded integrally with the handle portion 17 of the knob and extends from the cylindrical base 75.

The skirt 65 is formed of a suitable metal such as an aluminum stamping. The skirt is formed with a central opening 91 which closely fits over the hub portion 69 of the knob 63. The skirt has a downwardly turned outer rim 93. The diameter of the central opening 91 is sufficiently large that the skirt is free to rotate relative to the hub portion 69 but is sufficiently small so that it cannot override the shoulder 73. An arcuate opening 95 is formed in the skirt between the central opening 91 and the outer rim 93. The pointer 87 extends through this opening and is bent over the skirt in the manner shown in FIG. 4.

A tab 97 is formed in the central opening of the skirt. This tab extends into the arcuate notch 85 formed in the annular wall 83 of the hub portion 69 to limit rotational movement of the skirt relative to the knob. A spring type locking washer or ring 99 fits over the annular wall 83 of the hub portion 69 and engages the skirt 15 to hold the skirt onto the hub portion 69 of the knob 63 and frictionally against the shoulder stop 73. The frictional force between the locking ring and the shoulder stop 73 can be adjusted to provide sufficient frictional resistance to prevent free rotation of the skirt relative to the hub until a predetermined rotational force is applied to overcome this frictional resistance.

Indicia 101 indicating temperatures, in either the Fahrenheit or Celsius scales, are applied to the handle portion surface of the skirt 65 near the outer rim 93 thereof so that the indicia will be positioned outwardly of the cylindrical base 75 of the handle portion 67 of the hub when the skirt is installed on the hub. The indicia 101 is referenced to a mark 102 located on the appliance 59.

Indicia 103 is applied to the hub portion of the skirt 65 along the circumferential periphery thereof. The indicia 103 includes radially extending linear marks 105, each of which is spaced apart an angular distance equivalent to a predetermined number of degrees of temperature as indicated by the indicia 101 and instructions including letters and arrows indicating the direction in which to move the skirt 65 relative to the knob 13 to raise or lower the temperature shown on the dial or indicia 101. The arcuate opening 95 is located between the locking washer 99 and the linear marks 105 so that the pointer 87 will be in alignment with these marks to aid in calibration of the dial.

The locking ring 99 will normally frictionally engage the skirt with sufficient force to prevent relative rotation between the skirt and knob. However, when the skirt and knob assembly is removed from the shaft, relative rotation between the skirt and knob may easily be accomplished by overcoming the frictional engagement of these two members within the limits of rotation provided by engagement of the tab 97 with the annular walls 83 surrounding the arcuate notch 85 of the hub portion 69. Thus, upon removal of the knob from the shaft, the dial may easily be calibrated.

I claim:

1. A knob and skirt assembly having a dial which can be calibrated relative to a control shaft, said assembly including:

a knob having a handle portion and a hub portion, the hub portion having a control shaft receiving socket at one end and a stop on the hub located inwardly of the socket end, a disc shaped skirt having a central opening adapted to receive the hub and to engage the stop to position the skirt relative to the hub, means to secure the skirt against the stop of the hub and frictionally resist rotation of the hub and the skirt relative each other until a predeterminal rotational force is applied to overcome this frictional resistance, a first set of indicia applied to the shirt on the handle portion side thereof along the circumferential periphery of the skirt, a second set of indicia applied to the skirt on the hub portion side therof along the circumferential periphery thereof, a pointer fixed relative to the hub and positioned to align with the second set of indicia, an arcuate opening formed in the skirt adjacent the second set of indicia with said pointer formed as part of the handle portion and extending through the arcuate opening for alignment with the second set of indicia, and means to limit rotational movement of the skirt relative to the hub when the frictional resistance between the skirt and hub is overcome.

2. The knob and skirt assembly of claim 1 in which the stop is a shoulder formed on the hub.

3. The knob and skirt assembly of claim 1 in which the means to limit rotational movement of the skirt relative to the hub includes an inwardly projecting tab formed on the skirt which fits in an arcuate notch formed in the hub with the angular extent of the notch being greater than that of the tab.

4. The knob and skirt assembly of claim 1 in which the means to secure the skirt against the stop of the hub and to frictionally resist rotation of the hub and the skirt relative to each other until a predetermined rotational force is applied to overcome this frictional resistance includes a spring type locking ring which engages the hub portion of the knob and the skirt to force the skirt into frictional engagement with the stop on the hub.

5. A knob and skirt assembly having a dial which can be calibrated relative to a control shaft, said assembly including:

a knob having a handle portion and a hub portion, a hub portion having control shaft receiving socket at one end and a stop on the hub located inwardly of the socket end, a disc shaped skirt having a central opening adapted to receive the hub and to engage the stop to position the skirt relative to the hub, tabs formed on the hub and bent against the skirt to secure the skirt against the stop of the hub and to frictionally resist rotation of the hub and the skirt relative to each other until a predetermined rotational force is applied to overcome this frictional resistance, a first set of indicia applied to the skirt on the handle portion side thereof along the circumferential periphery of the skirt, a second set of indicia applied to the skirt on the hub portion side thereof along the circumferential periphery thereof, a pointer fixed relative to the hub and positioned to align with the second set of indicia, and means to limit rotational movement of the skirt relative to the hub when the frictional resistance between the skirt and the tabs of the hub is overcome.

6. The knob and skirt assembly of claim 5 in which the pointer is formed on the hub and is bent against the skirt to align with the second set of indicia.

* * * * *